US006017032A

United States Patent [19]

Grippo et al.

[11] Patent Number: 6,017,032

[45] Date of Patent: Jan. 25, 2000

[54] LOTTERY GAME

[76] Inventors: Donald R. Grippo; Pauline E. Grippo, both of 670 Main St., Willimantic, Conn. 06226

[21] Appl. No.: 09/366,724

[22] Filed: Aug. 4, 1999

Related U.S. Application Data

[60] Provisional application No. 60/118,566, Feb. 3, 1999.

[51] Int. Cl.[7] ..... A63F 3/06

[52] U.S. Cl. ..... 273/138.1; 273/138 A; 273/139; 463/26; 463/27

[58] Field of Search ..... 273/138 A, 139, 273/143 R, 138.1, 138.2; 463/17, 18, 19, 26, 27, 28

[56] References Cited

U.S. PATENT DOCUMENTS

| | | | |
|---|---|---|---|
| 4,842,278 | 6/1989 | Markowicz | 273/138 A |
| 4,996,705 | 2/1991 | Entenmann et al. | 379/91 |
| 5,046,737 | 9/1991 | Fienberg | 273/139 |
| 5,129,652 | 7/1992 | Wilkinson | 273/139 |
| 5,158,293 | 10/1992 | Mullins | 273/139 |
| 5,282,620 | 2/1994 | Keesee | 273/138 A |
| 5,344,144 | 9/1994 | Canon | 273/138 A |
| 5,407,200 | 4/1995 | Zalabak | 273/139 |
| 5,497,990 | 3/1996 | Nanni | 273/138 A |
| 5,613,679 | 3/1997 | Casa et al. | 273/138.1 |
| 5,788,237 | 8/1998 | Fults et al. | 273/269 |

FOREIGN PATENT DOCUMENTS

| | | |
|---|---|---|
| 1302438 | 1/1973 | United Kingdom . |
| 2163662 | 3/1986 | United Kingdom . |

*Primary Examiner*—Jeanette Chapman
*Assistant Examiner*—Raeann Gordon
*Attorney, Agent, or Firm*—Richard C. Litman

[57] ABSTRACT

A lottery game includes two or more different denominational levels for game tickets, i.e., two or more groups of tickets with tickets in each group being priced differently from tickets in the other groups. All tickets in any one group are priced identically to one another. Wagers received from each ticket group are placed in a corresponding jackpot pool according to the denominational level or amount of the tickets sold for that pool. All wagers for each denomination are processed by a single central controlling authority, with wagers being distributed to each separate pool according to the corresponding wager denomination. Thus, the present game may provide a series of different and separate jackpot pools corresponding to each ticket price or denominational level. Jackpots or prizes are awarded from each pool to the winning bettor holding a ticket corresponding to that denominational level and jackpot. Alternatively, the pools may be combined and divided in accordance with the total amount of each wager denominational level group. The game may run for a predetermined period of time, or to a predetermined date, or through the sales of a predetermined number of tickets in a given denominational group or groups, as desired. Prizes (e.g., automobiles, etc.) may be awarded in addition to money, at the higher or highest denominational levels.

A percentage of each pool, or of the combined total, may be retained by the operating authorities for overhead, charitable or government use, etc., if so desired.

20 Claims, 3 Drawing Sheets

LOTTERY GAME

REFERENCE TO RELATED PATENT APPLICATION

This application claims the benefit of U.S. Provisional Patent Application Ser. No. 60/118,566 filed on Feb. 3, 1999.

BACKGROUND OF THE INVENTION

1. Field of the Invention

The present invention relates generally to gambling and games of pure chance, and more specifically to a lottery game. The present game provides multiple jackpots or pools, according to the number of different denominations of wagers made by bettors. The pools may be combined as a single pool, with the pool being divided according to the amount of each different denomination wagered, or may be separated into different pools for each denomination. In both cases, all wagers of all denominations are processed through a central controlling authority for the entire lottery.

2. Description of the Related Art

Lotteries, both private and state operated, are popular games with many people. The convenience of being able to purchase one or more lottery tickets for a state game, encourages many persons to play who might not otherwise gamble. Moreover, the worthy cause generally involved (state funding, charitable cause, etc.) also encourages many people to play such games.

Nonetheless, conventional lotteries have their drawbacks, which can be discouraging to some players. One such drawback is that many, if not most, such lotteries provide only a single level of play in the form of one ticket price or denomination. If a player wishes to play at a higher level, the only option is to purchase more tickets. Even so, such a player is still playing against a relatively large number of other bettors, as such ticket prices are generally kept low in order to encourage play.

The opposite side of this picture is the provision of relatively high priced tickets. This is often done for charitable causes, in which only a relatively small predetermined number of tickets are sold for a relatively large prize (automobile, etc.). The relatively high ticket price increases the odds of a single ticket winning the jackpot or prize, but discourages bettors who may not wish to gamble such a large amount on a single ticket.

Accordingly, the present invention provides a multiple level lottery game, in which bettors may wager any amount according to a plurality of predetermined wager levels (e. g., $1, $5, $10, etc.). However, the wagers are not placed in a single pool, but wagers from all tickets of each amount are placed in their own pool. Thus each pool contains various total amounts, with only those bettors having placed wagers at a given level or ticket price being qualified to win the jackpot from the pool consisting of the wagers made by those bettors at that level. The pools may remain separate, or may be combined, with the fraction of the pool of each wager level being returned to the winning bettor of that level.

A discussion of the related art of which the present inventor is aware, and its differences and distinctions from the present invention, is provided below.

U.S. Pat. No. 4,842,278 issued on Jun. 27, 1989 to Victor Markowicz, titled "Hierarchical Lottery Network With Selection From Differentiated Playing Pools," describes the interconnection of two or more state lottery games into a national (or multi-state regional) game. Winning odds are calculated based upon input from players throughout the entire region, and not just from a single state. Payoffs are provided according to the total amount wagered and the number of winning bettors, somewhat like a parimutuel system. However, Markowicz mentions only a single wager level (e.g., one dollar, although he indicates that other wager amounts may be used) throughout his disclosure, and is silent regarding any provision for multiple wager levels and corresponding pools, as provided by the present invention.

U.S. Pat. No. 5,046,737 issued on Sep. 10, 1991 to Debra Fienberg, titled "Lottery-Type Game System With Bonus Award," describes a lottery game in which the multiple levels may only be achieved by certain players, by chance. A relatively small number of players are randomly eligible for play at a second level, and the Fienberg disclosure provides for additional levels as well. However, Fienberg is silent regarding any means for distributing wagers in a single payoff for each wager denomination according to different amounts bet by different numbers of players, as provided by the present multi-level lottery game.

U.S. Pat. No. 5,158,293 issued on Oct. 27, 1992 to Wayne L. Mullins, titled "Lottery Game And Method For Playing Same," describes another multiple level game, in the sense that players may be sequentially eligible for different prizes or payoffs during the course of play, as in the Fienberg '1737 U.S. Patent discussed immediately above. However, as in the Fienberg disclosure, Mullins makes no mention of any different wagering denominations by different groups of bettors, and resulting different pools and accordingly different prizes or payoffs, as provided by the present game system.

U.S. Pat. No. 5,282,620 issued on Feb. 1, 1994 to Roger N. Keesee, titled "Lottery Game And Method Of Playing A Lottery Game," describes a parimutuel game incorporating a plurality of game terminals and ticket printers which communicate with a central processor, in the manner of many known lottery type games. The present game differs from the Keesee game, in that Keesee describes his process as calculating the progressive jackpot prize(s) before wagers are placed. Thus, Keesee requires an estimate of the money to be collected by wagers, before the total amount of those wagers are known. The present system operates essentially in real time, and calculates payoffs based upon the wagers made to that point. Also, Keesee does not describe the use of wagers of different denominations and corresponding separate pools, or at least a single pool which is divided according to the percentage of wagers of each denomination placed therein, as provided by the present lottery game invention.

U.S. Pat. No. 5,407,200 issued on Apr. 18, 1995 to James M. Zalabak, titled "Lottery-Type Gaming System Having Multiple Playing Levels," describes a "pyramid" type game in which successive wagering levels are provided, with each level providing an increased chance of winning due to the removal of at least one game symbol from each successively higher level. Zalabak does not describe any different levels due to differing wager amounts or denominations, as provided by the present lottery game, nor does he describe any means of dividing the pool, or of providing separate pools, corresponding to separate groups comprising different wager amounts or denominations, as provided by the present lottery game.

U.S. Pat. No. 5,613,679 issued on Mar. 25, 1997 to Nikko Casa et al., titled "Method Of Playing A Lottery Game," describes a game in which two drawings are held for each game. The first drawing determines the winning bettor, while the second drawing determines the winning recipient of a group of worthy recipients (schools, charitable institutions, etc.). The Casa et al. system divides the jackpot or pool conventionally, in accordance with conventional state-run lotteries and the like for financing various governmental operations, rather than dividing the jackpot in accordance with the different denominations of wagers placed by different groups of bettors, as in the present lottery game. Casa et al. are silent regarding any amount or denomination of wager or wagers, and do not describe any wagers, or prize awards, based upon different wager amounts or denominations, as provided by the present game.

U.S. Pat. No. 5,788,237 issued on Aug. 4, 1998 to J. Wesley Fults et al., titled "Lottery-Type Gaming Method Having Multiple Playing Levels," describes a "Bingo" type game in which different levels of prizes or awards are provided. Fults et al. provide exemplary winning amounts (e. g., $250, or instant winners of $1, $5, $10, etc.), but do not divide the pool into different fractions corresponding to different wager denominations by different groups of bettors, as provided by the present lottery game invention. Moreover, Fults et al. make no provision for different wager amounts or denominations, as provided by the present game.

British Patent Publication No. 1,302,438 published on Jan. 10, 1973 to Ticket Seal Ltd., titled "Improvements Relating To Lottery Tickets," describes a lottery ticket having a plurality of player selectable tear-off panels, each covering a symbol on the ticket. The player removes or opens only a few of the panels to expose the symbols therebeneath, simulating the symbols displayed by a "fruit machine" (i. e., slot machine). The Ticket Seal patent publication is directed solely to the configuration and construction of a lottery ticket incorporating the above features. The Ticket Seal patent publication does not describe any particular wager amounts, much less any grouping of wagers according to different wager denominations and corresponding division of a pool to provide corresponding payoffs, as provided by the present lottery game invention.

British Patent Publication No. 2,163,662 published on Mar. 5, 1986 to Glendinning Companies Inc., titled "Lottery Game," describes a game and card configuration therefor, in which the cards each have a plurality of separate, obscured winning or losing indications which are "scratched off" by the player. The cards comprise two different types. The first type includes the same indication under each obscured area, thus assuring that a player drawing such a card will certainly either win or lose. The game control may control the issuance of winning first type cards. The second type includes a series of different obscured indicators, with a player revealing a single one of the indicators during play. Thus, any winnings of the second type of card occur randomly. This division of the method of play, and adjustment of the odds, is unlike the present lottery game in which different players may purchase chances of different denominations, with wagers from each group of players purchasing chances of a given denomination being placed in a separate pool, or corresponding fraction of a larger pool comprising wagers of all denominations.

In addition to the above, the present inventors are aware of various parimutuel games and systems which have been developed in the past. In such parimutuel systems, bettors may place wagers of various predetermined amounts upon the outcome of a future event (horse race, etc.). The winnings are distributed not only according to the outcome of the race or event and the previously calculated odds of the outcome occurring, but also according to the amount wagered by winning bettors, e. g., a $5 wager would win two and one half times more than a $2 wager. The present game does not require any skill, as in the knowledge of horses and conditions for a horse race, but is a pure chance game. Moreover, the present game does not provide for the possibility of multiple winners each independently and successfully wagering on the same outcome, and corresponding adjustment of the payoff odds to each bettor, as in a parimutuel horse race wagering system, but rather provides equal odds for all bettors in each of the wagering levels or denominations.

None of the above inventions and patents, either singly or in combination, is seen to describe the instant invention as claimed.

SUMMARY OF THE INVENTION

The present invention comprises a lottery game and method of play thereof, in which provision is made for wagers at different denominational levels (e. g., $1, $5, $10, etc.). Each wager of a given denominational level is placed in a separate jackpot pool, with the winner or winners paid from that pool, comprising only a bettor or bettors who had placed a wager or wagers at that denominational level. Alternatively, the wagers may be placed in a single pool, with winnings from the pool being divided according to the fraction of wager amounts collected of each denomination and paid to a winning bettor or bettors correspondingly. In either case, all wagers of all denominations pass through a central controller or agency, where they are distributed to the appropriate pool or pool fraction or portion.

The above arrangement also permits a portion of each purse or pool to be retained by the controlling agency, to cover overhead and profit (in the case of a commercial game), or overhead and contribution to another agency (e.g., schools, etc., in the case of a government run lottery game). Drawings for the present lottery game may be determined by a predetermined time and date, or perhaps period or duration of ticket sales, or by reaching a predetermined number of ticket sales. The awards or prizes need not be strictly monetary. As an example, the winning purchaser of a relatively larger value ticket could win money plus some additional article (automobile, boat, etc.), whereas the winning purchaser of a lesser value ticket may win only cash.

The payoffs of the present game are thus dependent not only upon the number of bettors in each ticket denomination category, but also upon the amount or denomination of that particular wager category. As an example, one thousand bettors each wagering one dollar, would provide a pool (or portion of a larger pool) having a value of one thousand dollars. Five hundred bettors each wagering five dollars each, would provide a pool (or portion of a larger pool) of two thousand, five hundred dollars. If a single winning ticket were drawn from each denominational portion of the pool, the winning one dollar bettor would win one thousand dollars (less any percentage for operational expenses, etc.) while the winning five dollar bettor would win two thousand five hundred dollars (less any percentage for expenses, etc.).

Accordingly, the present lottery game provides a means for bettors to judge and select ticket options not only according to the denomination or amount of the ticket purchase, but also according to the perceived odds, which will vary according to the number of bettors placing wagers in any one denomination level. Generally, higher ticket denominations will attract fewer bettors, thus increasing the chances of winning for a single bettor. Also, the pool amount per bettor is higher for bettors placing higher valued wagers. A bettor must weigh these factors prior to placing a bet at a given wager level, in the present lottery game.

Accordingly, it is a principal object of the invention to provide an improved lottery game having multiple wager levels, according to the denomination level of the wager or ticket purchased by bettors.

It is another object of the invention to provide an improved lottery game in which the total amount of wagers of each denominational level are placed in separate pools, or alternatively within a single pool which is divided to correspond with the total amount of wagers of each denominational level.

It is a further object of the invention to provide an improved lottery game in which wagers are processed by a single central controller for all wagers, with the controller calculating the amount to be placed in each separate wager pool or fraction of a larger pool corresponding to a given group of wager denominations.

An additional object of the invention is to provide an improved lottery game in which the end is determined by a predetermined date, period of ticket sales, or number of tickets sold in any one or all of the denominational levels, as desired.

Still another object of the invention is to provide an improved lottery game in which winning bettors at larger denominational levels may receive a prize in addition to a portion of the pool, or pool fraction, for that denominational wager level.

Yet another object of the invention is to provide a lottery game in which losing tickets from previous games may be exchanged for one or more tickets for a new game.

Another object of the invention is to provide a lottery game in which tickets may be provided in exchange for articles other than money, such as purchase receipts, wrappers or packaging, etc.

A further object of the invention is to provide a lottery game in which tickets may be provided in exchange for performing an act, such as visiting a store or other activity as desired or required.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present lottery game allows bettors to select the amount of the desired wager, according to a predetermined number of different wager denominational levels of the game. Each of the wager denominational levels corresponds to a separate wager or jackpot pool, or alternatively a corresponding fraction of a single jackpot pool. In accordance with the present lottery game, bettors may select the amount they wish to wager from a series of different denominational levels, and purchase a single lottery game ticket corresponding to that denomination or amount. The total wagers of each denominational level go into a separate jackpot pool, or alternatively form a corresponding fraction or division of a single larger pool. Thus, winning bettors receive a jackpot or other prize which is proportional to the amount collected in the jackpot pool which corresponds to the denominational level of their wager.

Figure 1:
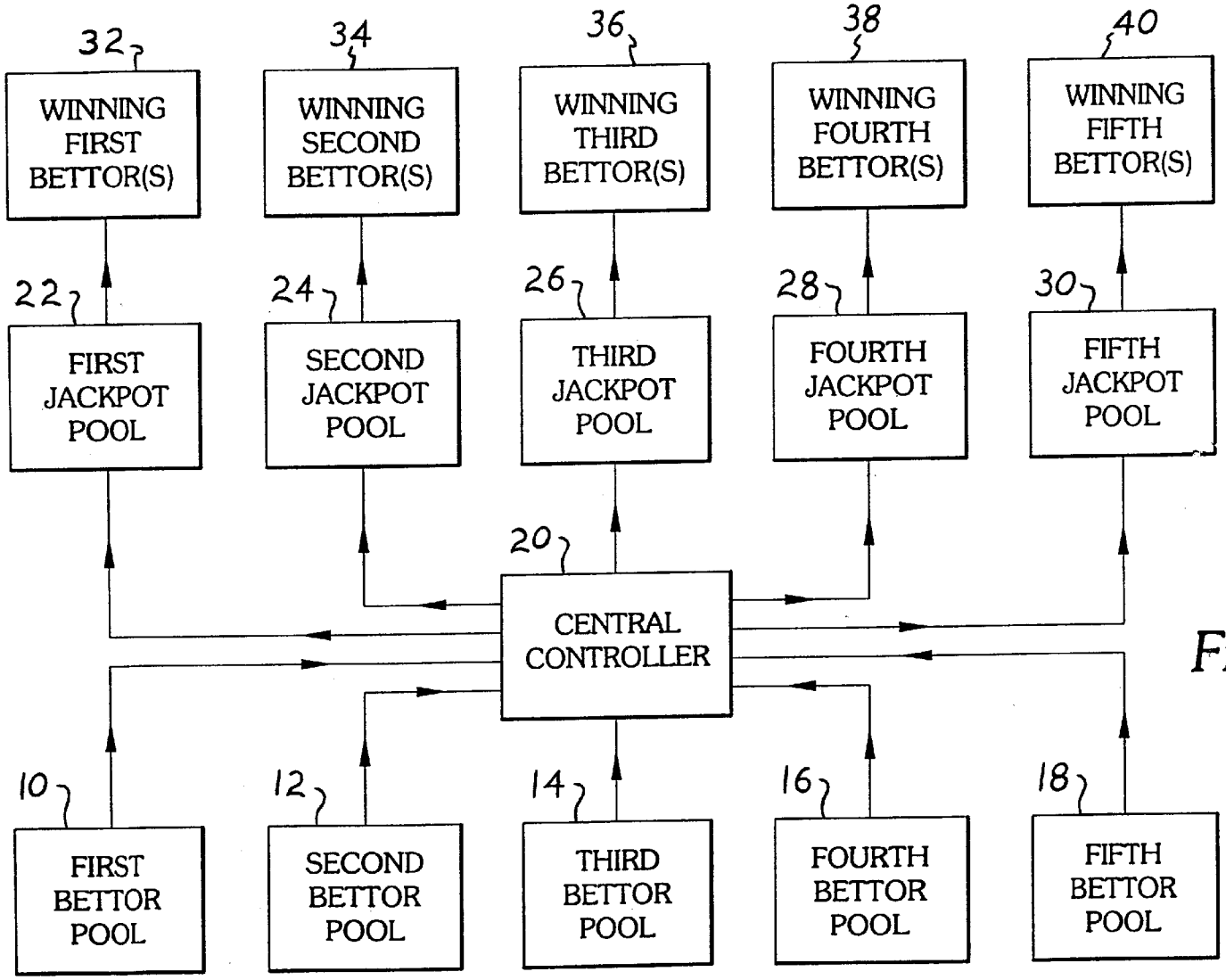
FIG. 1 is a schematic diagram showing the separation of denominational levels of wagers and corresponding jackpot pools.

FIG. 1 provides a block or schematic diagram showing the general process of the present lottery game invention. First, a series of wager denominational levels and corresponding separate bettor pools, respectively 10 through 18, are established, with the bettor pools each including a plurality of bettors each wagering a like amount and with different bettor pools corresponding to different wager denominational levels. As an example, the first bettor pool 10 may include bettors each wagering one dollar, i. e., purchasing a one dollar ticket. The second pool 12 may include bettors making two dollar wagers, the third pool for bettors making five dollar wagers, the fourth for ten dollar wagers, etc.

The establishment of different bettor pools corresponding to different wager denominational levels, need not be limited to only five such pools 10 through 18 as described herein, nor to the exemplary amounts noted above. A greater or lesser number of such separate pools may be provided as desired. Also, such separate bettor pools may be provided for relatively large amounts (e. g., ten thousand dollars, etc.) or for differing amounts of foreign currency, etc., as desired.

The wagers placed in each pool 10 through 18 are processed through a central controller 20, which may be a centralized authority for a state lottery, or a central computerized processor, etc., as is known in the art. The central controller 20 records each of the wagers made in each of the different bettor pools 10 through 18, and assigns the wagers to corresponding separate jackpot pools, respectively first through fifth jackpot pools 22 through 30, as shown generally in FIG. 1. As an example of the above, if ten thousand bettors each place one dollar wagers in the first jackpot pool 22, there will be a total of ten thousand dollars in that pool 22. If eight thousand bettors each purchase two dollar lottery tickets, there will be a total of sixteen thousand dollars in the second jackpot pool 24. In a like manner, if five thousand bettors purchase five dollar tickets, a total of twenty five thousand dollars will be assigned to the third jackpot pool 26. The process continues, with the central controller 20 determining how many wagers of each denominational level have been placed, and placing those wagers in the corresponding jackpot pool.

When wagering and/or ticket sales have ended for a particular lottery game, the central controller 20 may be used to select randomly a winning ticket or tickets from each of the jackpot pools 22 through 30, corresponding to the denomination level of the ticket or tickets purchased. In other words, the central controller 20 randomly selects a winning ticket number or entry from the first bettor pool 10, and provides a payoff corresponding to the total amount collected in the corresponding first jackpot pool 22. The controller 20 then (or essentially simultaneously) randomly selects a winning ticket number or entry from the second bettor pool 12, and provides a payoff corresponding to the total amount collected in the corresponding second jackpot pool 24. The process continues until a winning bettor or bettors, e. g., winning bettor(s) 32 through 40 of FIG. 1, has/have been randomly and independently selected from each of the bettor pools 10 through 18.

It will be seen that other winner selection means may be used, if so desired. For example, a conventional lottery winning selection means, such as randomly drawn numbered balls or the like, may be used, or a ticket stub corresponding to one of the lottery tickets sold may be drawn, etc. Also, while like ticket numbers could be provided for each of the denominational levels of the present game and a single winning number selected for all levels, this is impractical, as the winning number must be within the group of numbers corresponding to the smallest number of tickets sold or wagers made. Thus, all ticket numbers above that smallest number, would have no chance in a common drawing.

Figure 2:
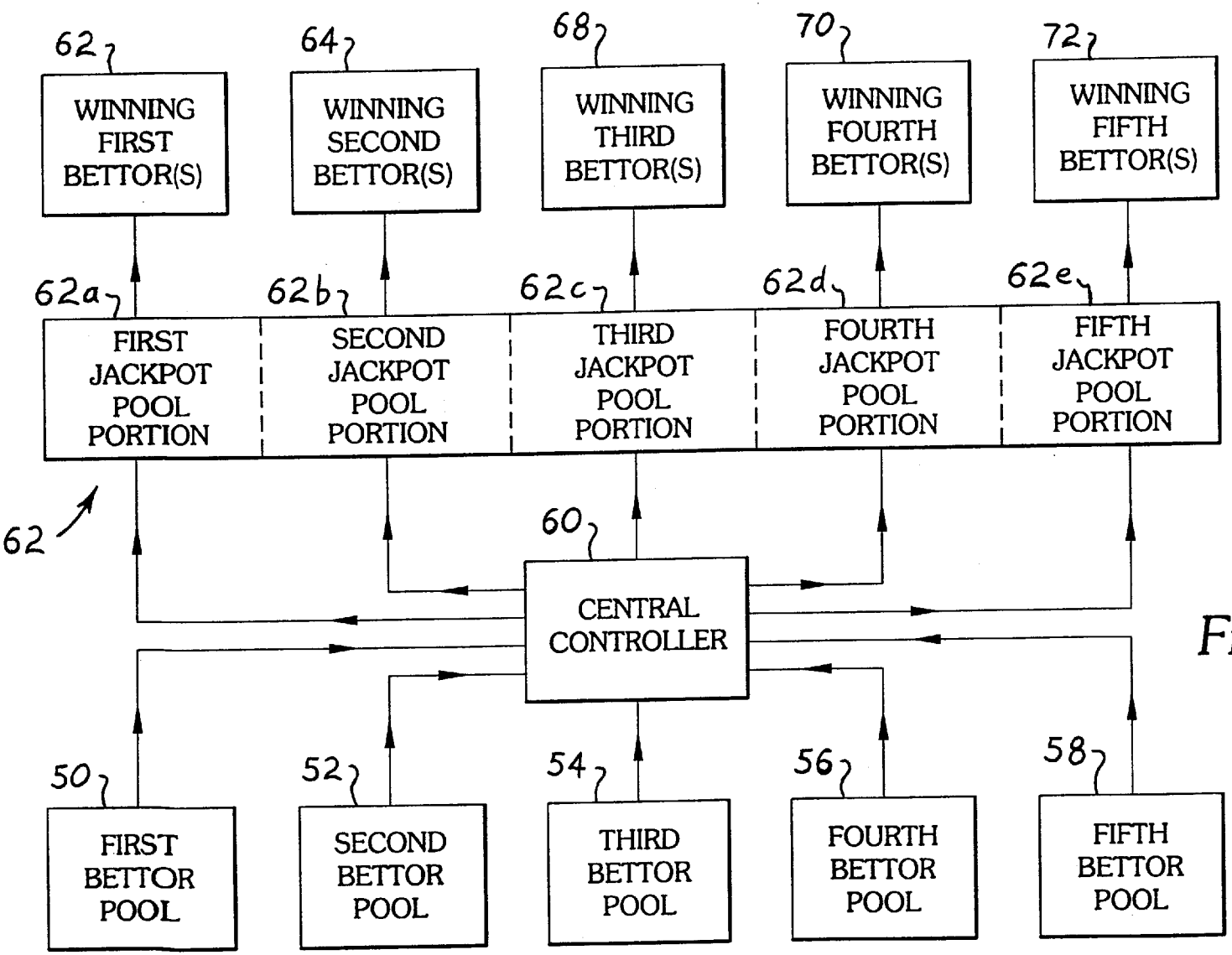
FIG. 2 is a schematic diagram showing the separation of denominational levels of wagers and corresponding division of a single jackpot pool.

FIG. 2 provides a block or schematic diagram differing somewhat from that of FIG. 1, in that each of the jackpot pools are combined into a single pool. Otherwise, the system of FIG. 2 is quite similar to that of FIG. 1. In FIG. 2, a plurality of first through fifth bettor pools, respectively 50 through 58, is provided, with each of the pools 50 through 58 corresponding to a specific wager or ticket denomination level (e. g., $1, $2, $5, $10, etc.), as described further above for the different bettor levels 10 through 18 of the system of FIG. 1. All of the wagers are processed through a central controller 60, with the controller 60 tracking the number of individual wagers of like denomination level made in each of the bettor pools 50 through 58, and the total amount of the wagers received from each of the bettor pools 50 through 58.

The controller 60 of the system of FIG. 2 then assigns all of the wagers to a single jackpot pool 62, rather than to a series of separate jackpot pools, as in the system of FIG. 1. However, the controller 60 continues to track the total amount of each wager group, i. e., the wagers of each specific denomination level placed by bettors of each of the separate bettor pools 50 through 58, and assigns the total wagers of each denomination level to a separate secondary jackpot pool, respectively 62*a* through 62*e* of FIG. 2. Each secondary pool corresponds to the denomination level or amount of each one of the corresponding first through fifth bettor pools 50 through 58.

When the game is ended and winning bettors are selected, the controller 60 provides payoffs to each of the winning bettors, e.g., winning first through fifth bettors 64 through 72 of FIG. 2, in accordance with the amount collected in the corresponding ones of the secondary jackpot pools 62*a* through 62*e*. As the controller 60 has determined the total amount wagered by each of the bettor pools 50 through 58 for distribution to the corresponding secondary jackpot pool portions 62*a* through 62*e*, the controller 60 may also distribute equitably the winning share from each of the secondary pool portions 62*a* through 62*e* for the corresponding first through fifth winning bettors 62 through 72. As in the case of the system of FIG. 1 discussed above, the controller 60 may also retain some percentage of each of the payoffs for overhead, charitable contribution share, etc., as is known in other lottery games.

Figure 3:
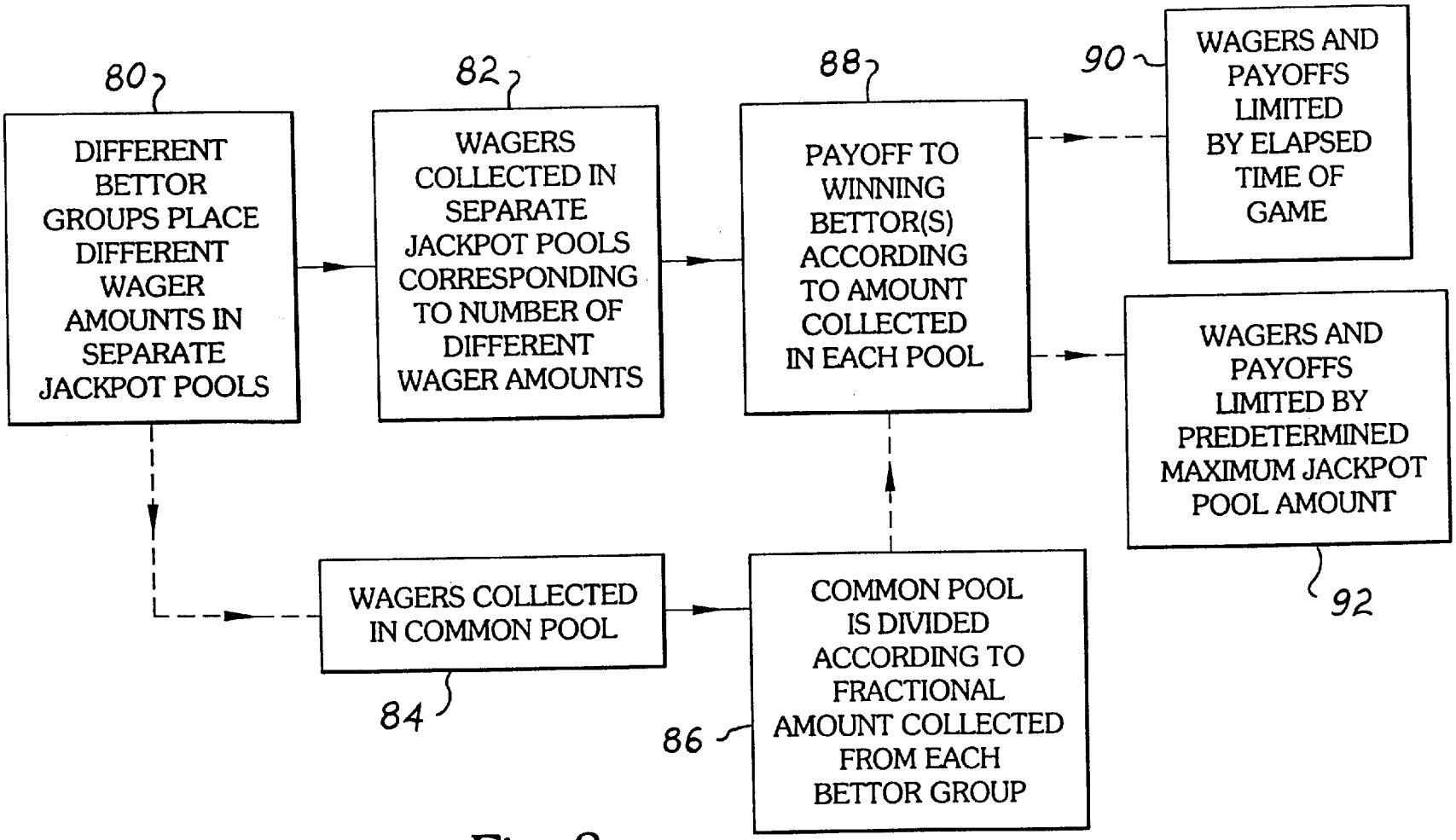
FIG. 3 is a flow chart showing the general sequential steps in the method of operation of the present lottery game.

FIG. 3 provides a flow chart showing the general steps in the methods of operation of the embodiments of the present lottery game. The various embodiments of the present system may be implemented using existing apparatus, such as a central controlling authority and a plurality of remote ticket dispensing terminals or the like, as is known in the art. However, the controlling authority (computer, etc.) must be programmed to distribute the income from ticket purchases to separate jackpot pools or secondary jackpot pool portions according to the separate denomination levels and corresponding bettor pools established, in keeping with the present system embodiments.

Once the system has been set up, bettors of the different bettor groups which correspond to the different ticket denomination levels, may place their wagers in the series of corresponding different jackpot pools as provided by the central controlling authority, as indicated generally by the first and second steps 80 and 82 of FIG. 3. Alternatively, all wagers of different denomination levels may be collected in a common pool, as indicated in the alternate second step 84 of FIG. 3, with that common pool being divided into a series of secondary pools each corresponding to the fraction of the total wagers received of each denomination level, as indicated by the alternate third step 86 of FIG. 3.

Once all wagers have been placed, winning bettors in each denomination level or category are randomly selected, either by means of the central controller or by some other means (numbered balls, drawing of ticket stubs, etc.), as indicated generally by the third step 88 of FIG. 3. Payoffs to each of the winning bettors of each different denomination level or amount, are provided from the corresponding jackpot pools, or secondary pool portions as appropriate, depending upon the particular embodiment of the present lottery game system. Again, some portion or percentage of each jackpot pool or secondary pool portion may be retained by the operators of the game for overhead, charitable contributions, government operations, etc., as is known in the operation of other lottery type games and systems.

The present lottery game embodiments may include additional variations thereon, if so desired. For example, a winning bettor or bettors wagering larger denomination amounts (e. g., $20, $50, $100, etc.) might receive merchandise or another article (e.g., an automobile, boat, trip, etc.) in addition to a monetary payment, depending upon the number of bettors in that particular higher level pool, and other factors.

Also, the time period of the game could be adjusted as desired (e.g., one week, one month, or shorter periods, such as a few days, or even one or more hours, for casino type games) in order to provide timely payouts to retain interest by bettors, and to limit the number of bettors and corresponding amounts collected in each of the pools or pool portions as desired. Such a time limitation for the game is shown generally in the optional fourth step 90 of FIG. 3.

Alternatively, the game may be limited by some predetermined maximum jackpot pool amount collected in each of the different pool denomination levels, or in each secondary pool, as desired. Such a limit is easily arranged, as the desired limit for a given jackpot pool denomination level need only be divided by the denominational level or amount of the corresponding tickets to determine the maximum number of tickets to be sold. In a similar manner, the overall amount collected in all pools could be limited to a predetermined maximum, but each separate ticket denomination level would not be specifically limited in such a case. Wager limiting means is shown generally in optional step 92 of FIG. 3.

The present lottery game may include other provisions, as well. In any lottery or gambling game or system, there will be a far greater number of losing tickets or players than winners. Accordingly, the present game provides a means for losing players to potentially recover their losses, by redeeming a losing ticket or tickets for a new ticket or tickets for a forthcoming game. As an example of the above, losing tickets may be redeemed at a five to one ratio for new tickets for a future game or games. A player who has acquired five one dollar losing tickets, may redeem them for a single one dollar ticket for a new game, if desired. (A player with a single five dollar losing ticket may redeem that ticket for a single one dollar ticket, in certain circumstances, if so desired.) Larger numbers of losing tickets, or higher denominations of losing tickets, may be redeemed similarly, e.g., fifty losing one dollar tickets for a ten dollar ticket, etc.

It will be seen that the above described redemption ratio is exemplary, and that other ratios (e.g., ten to one, three to one, etc.) may be provided as desired. As another example of the above, a player who has acquired three losing ten dollar tickets, may be able to redeem those losing tickets for a single ten dollar ticket for a future game, at the exemplary three to one ratio noted just above. Alternatively, the player redeeming three losing ten dollar tickets, may receive ten one dollar tickets, two five dollar tickets, or some combination thereof, depending upon the specific rules of the game. As another example, a player may have acquired thirty losing one dollar tickets, and redeem those thirty losing tickets in the same manner, i.e., for a single ten dollar ticket, or some combination of tickets totaling ten dollars in cost.

Other means of acquiring tickets for use in playing the present lottery game may be provided, as well. For example, an advertiser, business, or the like may establish a relationship with the operator of the present lottery game in which players may purchase tickets using some collateral other than money, such as purchase receipts, product packaging or labeling (e.g., food wrappers), etc., in accordance with the arrangement between the establishment and the game operator. The game operator collects the appropriate non-monetary collateral from the bettors or players and presents it to the advertising or business establishment, whereupon the establishment reimburses the game operator for the equivalent amount of funds required to purchase the tickets provided for the non-monetary collateral. The above arrangement may still provide for different denominations of tickets, just as those sold under more conventional circumstances. For example, a single one dollar ticket may be provided in exchange for a single product label or the like, while a five dollar ticket may be exchanged for five such product labels. This has essentially the same effect as the different denominations of the different jackpot pools of the present game described further above, in that more players are likely to exchange single ticket collateral items (wrappers, etc.), or perhaps two or three such items, for one, two, or three one dollar tickets, than are likely to acquire sufficient such items for exchange for larger denomination tickets. However, such non-monetary collateral may be treated essentially as money at the discretion of the game operator and cooperating establishment, who may provide different ticket denominations, and/or numbers of tickets, depending upon the number and/or value of the agreed upon non-monetary collateral.

Another means of providing tickets to players without requiring monetary payment, is through a similar agreement with a commercial entity or the like, wherein players are given tickets in return for performing some act, such as visiting a store. This system is also workable in non-commercial environments, wherein players may be provided with tickets for performing some other desired act or service, e.g., blood donation, safe driving, etc., as desired and agreed upon by the controlling authority of the present lottery game and the agency or entity working therewith.

The media may use the present ticket dispensing systems to great advantage, as well. For example, a radio station may provide one or more lottery tickets to call-in listeners, in accordance with certain requirements or restrictions (e.g., tenth caller, first caller to correctly respond to a question, etc.). Alternatively, the system may be applied to mail-in responses, as well, either by conventional mail, or even computerized email.

It will be seen that various limits may be placed upon players acquiring tickets for play of the present lottery game under any of the above described circumstances, as desired by the controlling authority for the game. For example, players may be restricted to a certain number, or denomination, of tickets redeemed by using other tickets (or non-monetary collateral) over a given period of time. The controlling authority may establish a limit e.g., of no more than ten dollars worth of tickets (ten one dollar tickets, two five dollar tickets, etc.) which may be acquired by redeeming non-monetary collateral (wrappers, labels, etc.) and/or by redeeming losing tickets from previous games. Such limitations may be determined as required or desired by the controlling authority for the game, and/or any commercial or other entity with which the authority is working. Such limitations would have the effect of limiting the "professional" player, who spends considerable time and effort in acquiring the necessary non-monetary collateral by means other than product purchase, and/or acquires losing tickets from other players, rather than by personally purchased or acquired tickets retained after previous losses in the game.

In summary, the present lottery game system embodiments provide additional interest to players of such games, by providing a series of different denomination levels or amounts from which bettors may choose, in a single game. Alternatively, a bettor may select two or more such denomination categories or levels, as desired, with the bettor then having a chance to win in two or more corresponding wager or jackpot pools. It will be seen that a different number of tickets or chances may be sold in each denomination level, thus providing different odds for bettors wagering in each of the different levels. For example, it is likely that relatively fewer bettors will place wagers at the higher or more costly denomination levels, than at the lower and less costly levels. While each ticket or chance costs more at the higher levels, a bettor at those levels would have a correspondingly greater chance of winning. Bettors may adjust their chances accordingly, corresponding to the denomination level of the ticket(s) or chance(s) purchased.

Operators of lottery games using the present multiple jackpot systems may adjust the period of play, or set a date for selecting the winning ticket in each denomination level, in order to limit the number of chances sold and thus the amounts accrued in each of the jackpots or jackpot portions of the game. Such periods may be adjusted as desired to achieve some predetermined level in one or more of the jackpots or jackpot portions. Casino play may involve periods as short as an hour to a few hours, depending upon the arrangement made by the casino.

As noted further above, tickets or chances for the present game may be sold through conventional remote ticket dispensing machines, or by other means (over the counter, etc.). The present game system may make use of a considerable amount of the existing componentry for such games, with the present game primarily requiring reprogramming of such systems in order to function as described. The present game system is applicable to state run lotteries, casinos, and other organizations, with the specifics of the system being adjusted as desired for each specific application. For example, state and/or local organizations empowered to operate such games, may elect to give away some additional article or prize (automobile, etc.) in addition to a portion of the accrued jackpot at higher denominational levels, while winning players at relatively lower denominational levels may receive only a portion of the jackpot corresponding to that denominational level.

Other variations in the play of the present game, particularly in the provision of tickets for the game, may be provided as described above, e.g., non-monetary collateral exchanged for tickets, losing tickets from previous games exchanged for tickets for forthcoming games, etc. Such provision of tickets in exchange for items other than money may be implemented as desired by the controlling authority for the present lottery game, and/or any commercial or other entity with which the game operator is working.

Tickets may also be provided by various agencies in return for some action by a player (e.g., visiting a store, response to a radio call-in show, etc.), as arranged by the controlling authorities.

The present lottery game systems will prove particularly valuable to casino play, as bettors in such environments typically place higher wagers than bettors in state lotteries and the like, where the wagers are limited to a single predetermined amount. Thus, revenues can be increased for casino operations, as well as for other operations making use of the present lottery game systems. Knowledgeable bettors may increase their odds of winning, by recognizing those categories receiving less play and wagering accordingly in those categories. Thus, the present lottery game system embodiments will serve both the controlling organization as well as bettors interested in such games.

It is to be understood that the present invention is not limited to the embodiments described above, but encompasses any and all embodiments within the scope of the following claims.

We claim:

1. A method of operating a lottery game, comprising the following steps:

(a) providing a central controller;

(b) establishing a plurality of different wager denominational levels;

(c) further providing a plurality of bettor pools, corresponding to the number of the plurality of different wager denominational levels;

(d) separating each of the bettor pools according to the corresponding denominational level of the wager;

(e) further providing a plurality of jackpot pools, with each of the jackpot pools corresponding to one of the plurality of different wager denominational levels;

(f) separating each of the jackpot pools from one another;

(g) accepting a plurality of wagers corresponding to each of the different wager denominational levels;

(h) assigning wagers of each of the different wager denominational levels to a corresponding one of the jackpot pools, by means of the central controller;

(i) determining at least one winning bettor from each of the bettor pools; and (j) awarding the at least one winning bettor from each of the bettor pools, a payoff from the corresponding jackpot pool.

2. The method of operating a lottery game according to the method of claim 1, wherein the step of determining the at least one winning bettor from each of the bettor pools includes accomplishing the determination by the central controller.

3. The method of operating a lottery game according to the method of claim 1, wherein the step of determining the at least one winning bettor from each of the bettor pools includes using a manual system.

4. The method of operating a lottery game according to the method of claim 1, including the steps of:

(a) assigning different ticket denomination values to each of the jackpot pools, from a smallest ticket denomination level to a largest ticket denomination level; and (b) awarding a prize in addition to the payoff to the winning bettor of the largest ticket denomination level jackpot pool.

5. The method of operating a lottery game according to the method of claim 1, wherein the step of accepting a plurality of wagers includes limiting the number of wagers by providing a limited, predetermined number of tickets for each of the wager denominational levels.

6. The method of operating a lottery game according to the method of claim 1, wherein the step of accepting a plurality of wagers includes limiting the number of wagers by setting a predetermined time period for terminating the sale and provision of tickets.

7. The method of operating a lottery game according to the method of claim 1, wherein the step of accepting a plurality of wagers includes limiting the number of wagers by setting a predetermined date for terminating the sale and provision of tickets.

8. The method of operating a lottery game according to the method of claim 1, including the steps of:

(a) providing a plurality of lottery tickets for the game; and (b) redeeming at least one losing lottery ticket of the plurality of tickets, for at least one lottery ticket for a subsequent game.

9. The method of operating a lottery game according to the method of claim 1, including the steps of:

(a) providing a plurality of lottery tickets for play of the game;

(b) exchanging at least one lottery ticket for each bettor, for non-monetary collateral.

10. The method of operating a lottery game according to the method of claim 1, including the step of providing at least one lottery ticket to at least one of the bettors in exchange for performing an action required by the central controller.

11. A method of operating a lottery game, comprising the following steps:

(a) providing a central controller;

(b) establishing a plurality of different wager denominational levels;

(c) further providing a plurality of bettor pools, corresponding to the number of the plurality of different wager denominational levels;

(d) separating each of the bettor pools according to the corresponding denominational level of the wager;

(e) further providing a single jackpot pool;

(f) dividing the single jackpot pool into a plurality of divisional jackpot pools by means of the central controller, with each of the divisional jackpot pools corresponding to one of the plurality of different wager denominational levels;

(g) accepting a plurality of wagers corresponding to each of the different wager denominational levels;

(h) assigning wagers of each of the different wager denominational levels to the single jackpot pool and to a corresponding one of the secondary jackpot pools, by means of the central controller;

(i) determining at least one winning bettor from each of the bettor pools; and (j) awarding the at least one winning bettor from each of the bettor pools, a payoff from the corresponding secondary jackpot pool.

12. The method of operating a lottery game according to the method of claim 11, wherein the step of determining the at least one winning bettor from each of the bettor pools includes accomplishing the determination by the central controller.

13. The method of operating a lottery game according to the method of claim 11, wherein the step of determining the at least one winning bettor from each of the bettor pools includes using a manual system.

14. The method of operating a lottery game according to the method of claim 11, including the steps of:

(a) assigning different ticket denomination values to each of the divisional jackpot pools, from a smallest ticket denomination level to a largest ticket denomination level; and (b) awarding a prize in addition to the payoff to the winning bettor of the largest ticket denomination level jackpot pool.

15. The method of operating a lottery game according to the method of claim 11, wherein the step of accepting a plurality of wagers includes limiting the number of wagers by providing a limited, predetermined number of tickets for each of the wager denominational levels.

16. The method of operating a lottery game according to the method of claim 11, wherein the step of accepting a plurality of wagers includes limiting the number of wagers by setting a predetermined time period for terminating the sale and provision of tickets.

17. The method of operating a lottery game according to the method of claim 11, wherein the step of accepting a plurality of wagers includes limiting the number of wagers by setting a predetermined date for terminating the sale and provision of tickets.

18. The method of operating a lottery game according to the method of claim 11, including the steps of:

(a) providing a plurality of lottery tickets for the game; and (b) redeeming at least one losing lottery ticket of the plurality of tickets, for at least one lottery ticket for a subsequent game.

19. The method of operating a lottery game according to the method of claim 11, including the steps of:

(a) providing a plurality of lottery tickets for play of the game;

(b) exchanging at least one lottery ticket for each bettor, for non-monetary collateral.

20. The method of operating a lottery game according to the method of claim 11, including the step of providing at least one lottery ticket to at least one of the bettors in exchange for performing an action required by the central controller.

* * * * *